US007703299B2

(12) United States Patent
Schlosser et al.

(10) Patent No.: US 7,703,299 B2
(45) Date of Patent: Apr. 27, 2010

(54) ICE MAKING MACHINE, EVAPORATOR ASSEMBLY FOR AN ICE MAKING MACHINE, AND METHOD OF MANUFACTURING SAME

(75) Inventors: Charles E. Schlosser, Manitowoc, WI (US); Richard T. Miller, Manitowoc, WI (US); Daryl Gregory Erbs, Sheboygan, WI (US); Gregory F. Krcma, Manitowoc, WI (US)

(73) Assignee: Manitowoc Foodservice Companies, Inc., Sparks, NV (US)

( * ) Notice: Subject to any disclaimer, the term of this patent is extended or adjusted under 35 U.S.C. 154(b) by 780 days.

(21) Appl. No.: 11/472,601

(22) Filed: Jun. 22, 2006

(65) Prior Publication Data

US 2006/0288725 A1 Dec. 28, 2006

Related U.S. Application Data

(60) Provisional application No. 60/693,123, filed on Jun. 22, 2005, provisional application No. 60/709,325, filed on Aug. 18, 2005, provisional application No. 60/753,429, filed on Dec. 23, 2005, provisional application No. 60/789,099, filed on Apr. 4, 2006.

(51) Int. Cl.
*F25C 1/12* (2006.01)

(52) U.S. Cl. ..... 62/347; 62/515; 165/171

(58) Field of Classification Search ..... 62/66–74, 62/340–356, 515–524; 165/76–79, 168–171
See application file for complete search history.

(56) References Cited

U.S. PATENT DOCUMENTS 3,046,753 A 7/1962 Carapico, Jr.

(Continued)

FOREIGN PATENT DOCUMENTS

JP 2002081795 3/2002

(Continued)

OTHER PUBLICATIONS

PCT International Search Report and Written Opinion, mailed Nov. 20, 2007.

(Continued)

*Primary Examiner*—William E Tapolcai
(74) *Attorney, Agent, or Firm*—Michael Best & Friedrich LLP

(57) ABSTRACT

An ice-making machine having an ice-forming surface upon which ice is formed, a refrigeration system including a microchannel evaporator that cools the ice-forming surface, and a water-supply system. The microchannel evaporator includes a microchannel tube that facilitates a distributed cooling effect in a contact area between the microchannel tube and the ice-forming surface. In some embodiments, the microchannel tube includes a series of recessed portions that define insulated regions and divide the tube into non-insulated regions. The insulated and non-insulated regions can be dimensioned to form individual ice cubes on the ice-forming surface. In other embodiments, spaces between microchannel tubes and/or spaces between the ice-forming surface and microchannel tubes can form insulated regions at least partially defining the size and shape of ice produced by the ice-making machine. The ice-forming surface can be attached to the microchannel tubes by adhesive and/or cohesive bonding material (such as glue, epoxy, or other adhesive).

13 Claims, 14 Drawing Sheets

U.S. PATENT DOCUMENTS 3,230,736 A 1/1966 Swanson
3,280,588 A 10/1966 Brindley
3,430,452 A * 3/1969 Dedricks et al. ..... 62/138
4,255,941 A 3/1981 Bouloy
4,366,679 A * 1/1983 Van Steenburgh, Jr. ..... 62/347
4,555,913 A 12/1985 Ishiguro
4,590,774 A * 5/1986 Povajnuk ..... 62/347
4,601,178 A * 7/1986 Suyama et al. ..... 62/347
4,843,827 A * 7/1989 Peppers ..... 62/73
4,947,653 A 8/1990 Day et al.
4,995,245 A 2/1991 Chang
5,193,357 A 3/1993 Kohl et al.
5,237,837 A * 8/1993 Naruse et al. ..... 62/434
5,544,495 A * 8/1996 Anderson et al. ..... 62/457.7
5,562,157 A 10/1996 Hasegawa et al.
5,609,203 A 3/1997 Kinugasa et al.
5,634,270 A 6/1997 Lu
6,247,318 B1 6/2001 Stensrud et al.
6,286,331 B1 9/2001 Lee
6,397,939 B1 6/2002 Swiger et al.
6,536,517 B2 3/2003 Hoshino et al.
6,912,864 B2 * 7/2005 Roche et al. ..... 62/256
7,000,415 B2 * 2/2006 Daddis et al. ..... 62/255
7,017,355 B2 3/2006 Allison et al.
7,036,332 B2 5/2006 Hallin et al.
7,201,015 B2 * 4/2007 Feldman et al. ..... 62/347
7,222,662 B2 * 5/2007 Neumann ..... 165/133
2005/0150250 A1 7/2005 Allison et al.
2005/0183845 A1 * 8/2005 Munch et al. ..... 165/83

FOREIGN PATENT DOCUMENTS

JP 2005061778 3/2005

OTHER PUBLICATIONS

PCT International Preliminary Report on Patentability, Chapter II, mailed Jul. 16, 2009.

* cited by examiner

ICE MAKING MACHINE, EVAPORATOR ASSEMBLY FOR AN ICE MAKING MACHINE, AND METHOD OF MANUFACTURING SAME

CROSS-REFERENCE TO RELATED APPLICATIONS

Priority is hereby claimed to U.S. Provisional Patent Application Ser. No. 60/693,123 filed on Jun. 22, 2005, U.S. Provisional Patent Application Ser. No. 60/709,325 filed on Aug. 18, 2005, U.S. Provisional Patent Application Ser. No. 60/753,429 filed on Dec. 23, 2005, and U.S. Provisional Patent Application Ser. No. 60/789,099, filed on Apr. 4, 2006, the entire contents of which are incorporated herein by reference.

BACKGROUND OF THE INVENTION

Ice making machines are in widespread use for supplying cube ice in commercial operations. Typically, ice making machines produce a large quantity of clear ice by flowing water a chilled surface. The chilled surface is thermally coupled to evaporator coils that are, in turn, coupled to a refrigeration system. The chilled surface commonly contains a large number of indentations on its surface where water flowing over the surface can collect. As water flows over the indentations, it freezes into cube ice.

To harvest the ice, the evaporator coils are heated by hot, compressed refrigerant flowing through the evaporator coils, by heating elements located proximate the ice, and/or in other manners. Heat can be transferred to the chilled surface until it is warmed to a temperature sufficient to harvest the ice from the surface. Once freed from the surface, the ice cubes fall into an ice storage bin. The ice cubes produced by a typical ice making machine are pre-formed or regular in shape, and in some embodiments have a generally thin profile. In some ice making machines, the cubes are released from the chilled surface as individual cubes, while in other ice machines, the cubes are connected by a thin bridge of ice that is commonly fractured upon the ice falling into the storage bin.

Evaporators are commonly made using copper tubing in thermal contact with the chilled surface. Low-pressure, expanded refrigerant is passed through the copper tubing to chill the evaporator. The copper tubing can be secured (e.g. typically soldered or brazed) to a copper plate that distributes the chilling effect from the copper tubing. Because the copper tubing is cylindrical in shape, and because the copper plate is typically substantially flat, there is line contact between the two parts, which can reduce the efficiency and speed of heat transfer between the two parts.

SUMMARY OF THE INVENTION

In some embodiments, an ice making machine evaporator for forming ice is provided, and comprises a microchannel tube having internal walls defining a plurality of flow paths through the microchannel tube; a sheet having a first surface over which water flows during an ice making operation, the sheet coupled to the microchannel tube for thermal conductance therewith; and at least one of adhesive and cohesive bonding material coupling the first surface and the microchannel tube.

Some embodiments of the present invention provide a method of manufacturing an evaporator assembly for an ice making machine, wherein the method comprises positioning a microchannel tube having a plurality of refrigerant flow paths adjacent a surface of a sheet of thermally conductive material; pressing the microchannel tube and the sheet of thermally conductive material together; and coupling the microchannel tube and the sheet of thermally conductive material with at least one of adhesive and cohesive bonding material.

In some embodiments, an evaporator assembly for an ice making machine is provided, and comprises an ice forming sheet defining a plurality of ice forming locations, each of the plurality of ice forming locations having a width; a plurality of microchannel evaporator tubes, each of the plurality of microchannel evaporator tubes having a plurality of internal refrigerant passages and having a width substantially equal to the width of each of the plurality of ice forming locations; first insulating regions defined between adjacent ones of the plurality of microchannel evaporator tubes; and second insulating regions defined between adjacent ice forming locations along each one of the plurality of microchannel evaporator tubes.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
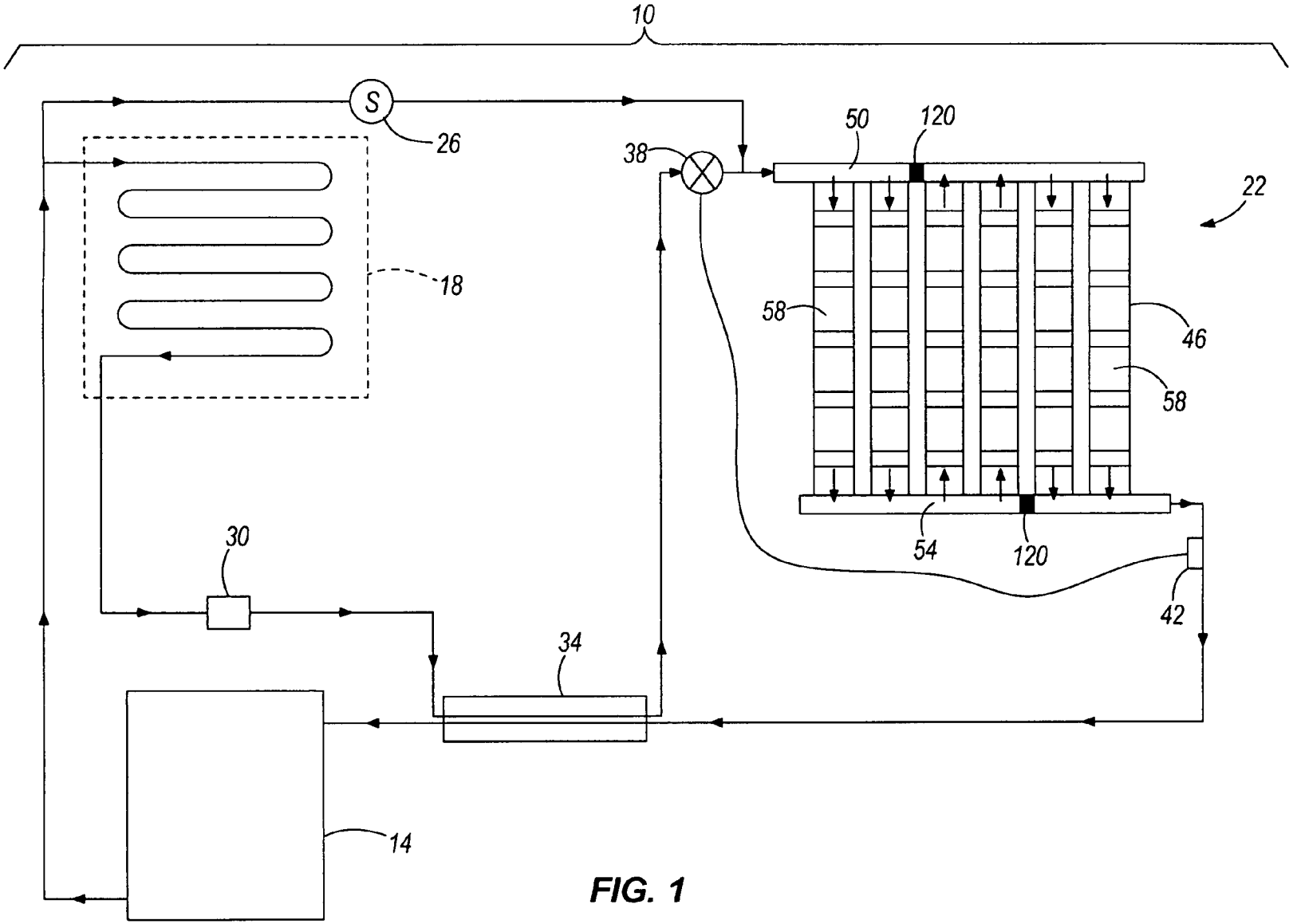
FIG. 1 is a schematic of an ice making machine according to an embodiment of the present invention, including a microchannel evaporator assembly and other components of a refrigeration system.

With reference to FIG. 1, the illustrated ice making machine 10 includes a refrigeration system having a compressor 14, a condenser 18, and a microchannel evaporator assembly 22. The refrigeration system further includes a solenoid valve 26, a dryer 30, a heat exchanger 34, an expansion valve 38, and a temperature-sensing bulb 42. Feedback control is used to modulate the expansion valve 38 in response to information from the bulb 42. Water is provided to the evaporator assembly 22 via a water supply system including water supply ports.

Figure 2:
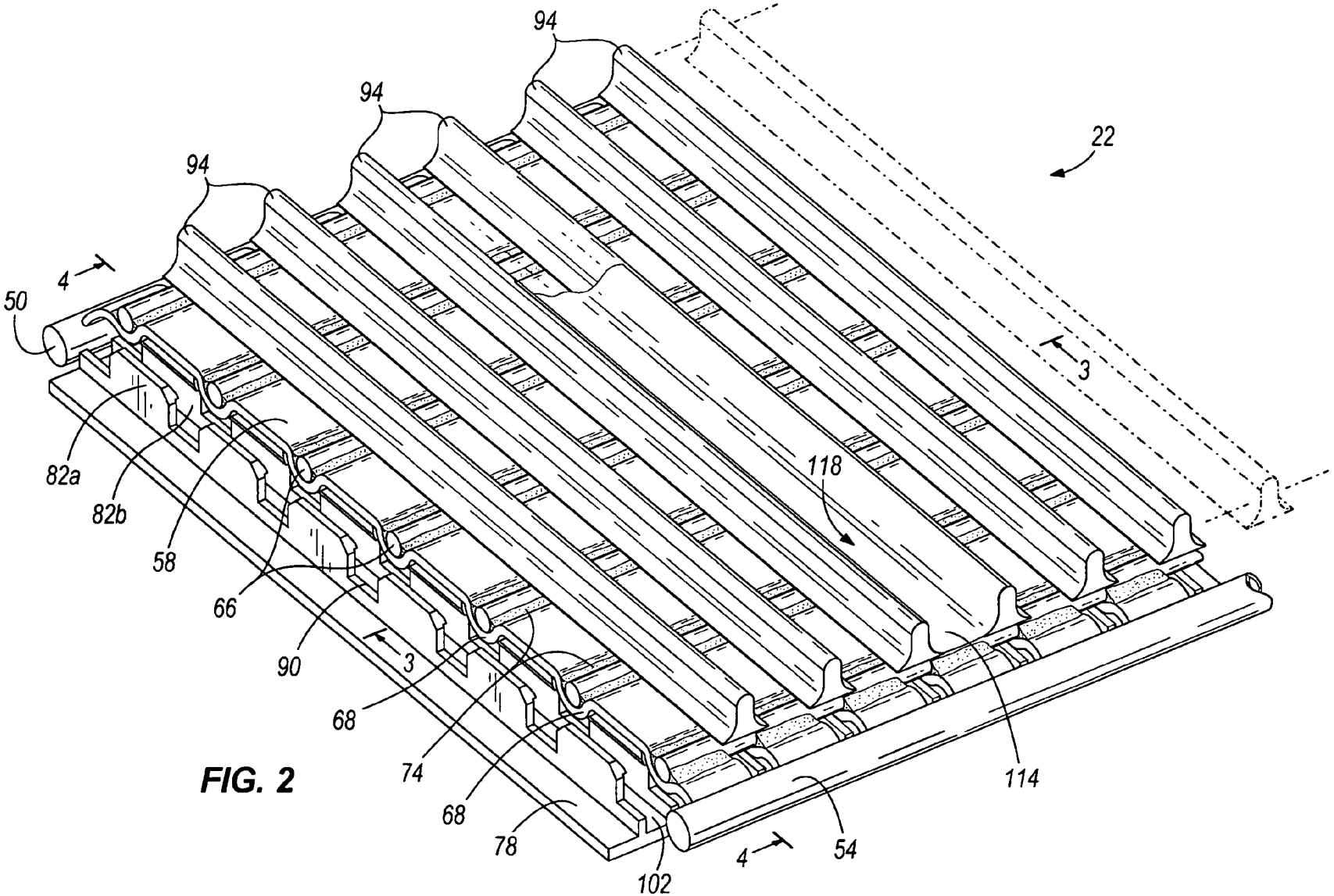
FIG. 2 is a partial cutaway perspective view of the evaporator assembly of FIG. 1.
Figure 3:
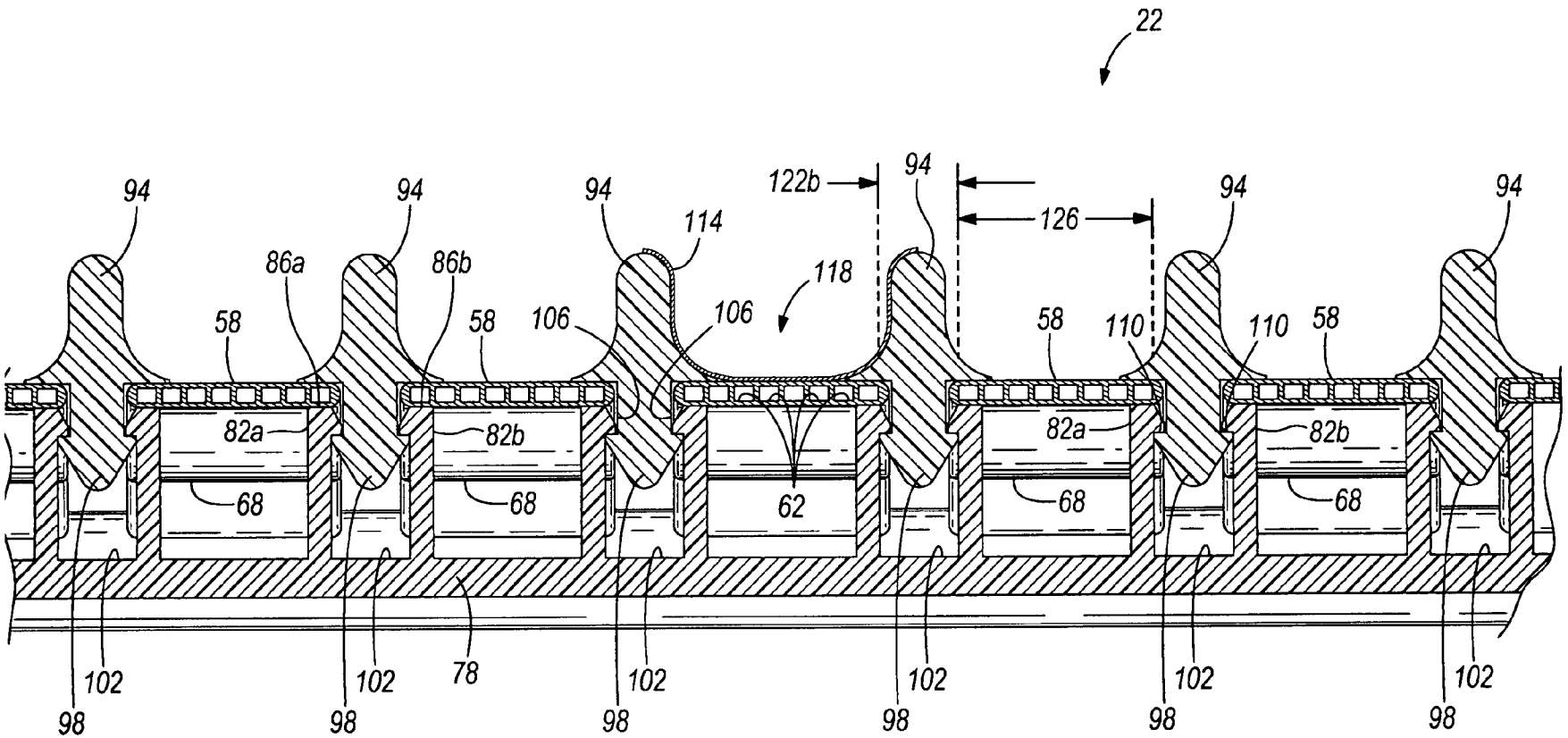
FIG. 3 is a cross-section of the evaporator assembly of FIG. 2 taken along line 3-3.

With reference to FIGS. 2 and 3, the evaporator assembly 22 includes an inlet header 50, an outlet header 54, and a plurality of microchannel tubes 58 fluidly communicating the inlet header 50 and the outlet header 54. The tubes 58 are substantially flat, and have a plurality of microchannels 62 formed therein (see FIG. 3). In the illustrated construction, the microchannels 62 have substantially rectangular cross-sectional shapes, with each microchannel 62 having a width dimension of about 1.4 mm and a height dimension of about 1.0 mm. Alternatively, the microchannels 62 may have different cross-sectional shapes (e.g., circular, triangular, ovular, trapezoidal, etc.), and may have a width dimension greater or less than 1 mm and a height dimension greater or less than 0.5 mm. The tubes 58 may be made from a metal having a high thermal conductivity, such as aluminum. However, the tubes 58 may be made from other metals having a relatively high thermal conductivity, such as copper or steel.

Figure 4:
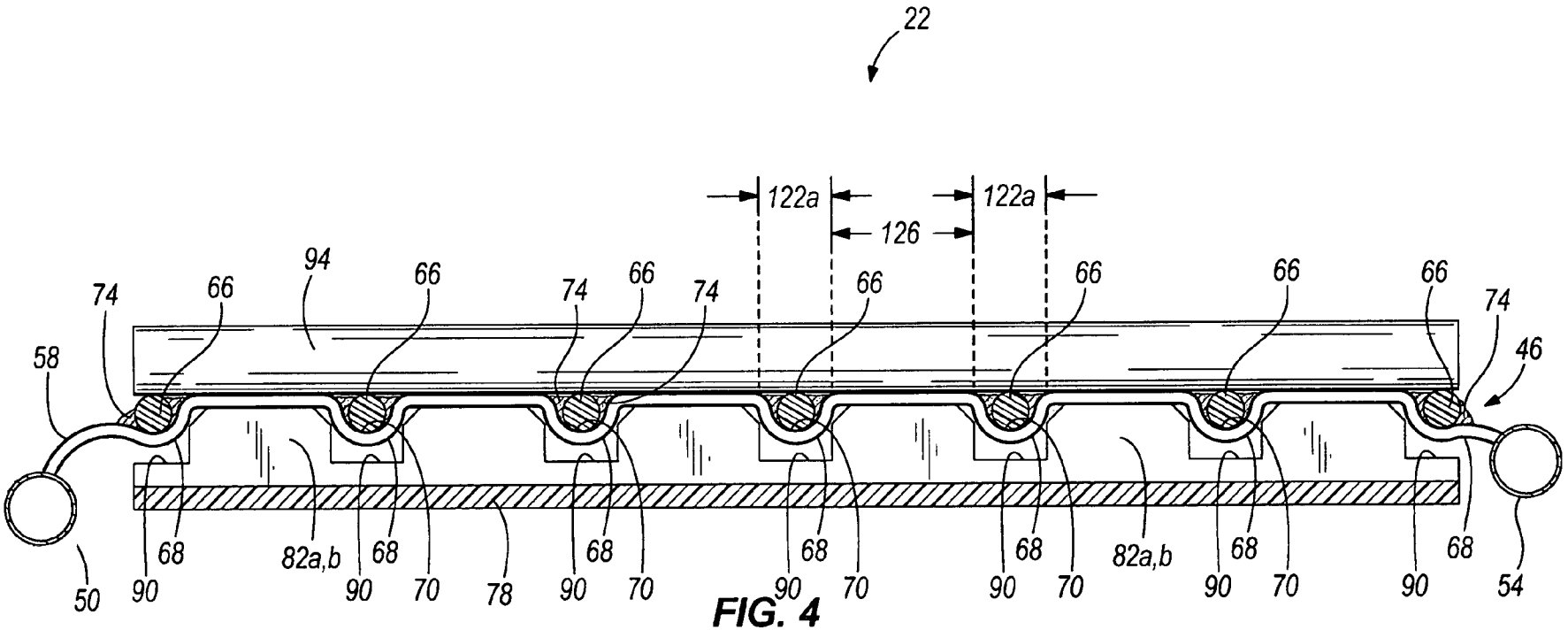
FIG. 4 is a cross-section of the evaporator assembly of FIG. 2 taken along line 4-4.

As shown in FIGS. 2 and 4, the tubes 58 are formed or bent to include recessed portions 68 extending along the width of the tubes 58. The recessed portions are spaced from each other by a distance that approximates the length of the cubes to be produced, which is about 20 mm in the illustrated embodiment.

The evaporator assembly 22 also includes insulating members 66 positioned in and secured to the recessed portions 68 of the tubes 58. In the illustrated construction, the insulating members 66 are configured as substantially cylindrical rods. Alternatively, the insulating members 66 may be configured to have any of a number of different shapes. For example, the insulating members 66 could have a shape that matches the shape of the recessed portions. The insulating members 66 are preferably made from a material having a relatively low thermal conductivity, such as any of a number of different plastics including PVC, polypropylene, or polyethylene.

The recessed portions 68 are sized and configured to receive the insulating members 66, such that no portion of the insulating members 66 extends above the top surfaces of the respective tubes 58 (see FIG. 4). In the illustrated construction, the insulating members 66 are coupled to the tubes 58 by an adhesive or cohesive material 74, such as glue, epoxy, or other adhesive, which fills the void between the insulating members 66 and top surfaces of the tubes 58. The adhesive or cohesive material 74 preferably also has a relatively low thermal conductivity.

With reference to FIGS. 2 and 3, the evaporator assembly 22 further includes a base 78 having upstanding projections 82*a*, 82*b* configured to support the microchannels 58. Particularly, pairs of upstanding projections 82*a*, 82*b* are configured to support side edges of adjacent tubes 58. As shown in FIG. 3, the pairs of upstanding projections 82*a*, 82*b* include upper surfaces 86*a*, 86*b* for supporting the tubes 58. As shown in FIGS. 2 and 4, the base 78 also includes notches 90 formed between the projections 82*a*, 82*b* along the length of the base 78. The notches 90 in the base 78 are sized to receive the recessed portions 68 of the tubes 58.

The evaporator assembly 22 also includes rails 94 configured to engage the pairs of upstanding projections 82*a*, 82*b*, such that the tubes 58 are secured between the rails 94 and the pairs of upstanding projections 82*a*, 82*b*. In the illustrated construction (see FIG. 3), the pairs of upstanding projections 82*a*, 82*b* each define a slot 102, and the rails 94 each include at least one engagement portion or rib 98 configured to engage the upstanding projections 82*a*, 82*b*. In the illustrated construction, the projections 82*a*, 82*b* and the rib 98 include projecting edges 106, 110 that engage each other. Alternatively, the projections 82*a*, 82*b* and the rails 94 may incorporate different structure to allow the rails 94 to engage the projections 82*a*, 82*b*.

Upon coupling the rails 94 to the projections 82*a*, 82*b*, the tubes 58 are sandwiched or secured between side edges of the rails 94 and the pairs of upstanding projections 82*a*, 82*b*. Such a connection is sufficient to secure the microchannels 58 to the base 78.

With reference to FIGS. 2 and 3, the evaporator assembly 22 also includes a metal skin or sheet 114 overlying the tubes 58 and the rails 94. Although only a portion of the sheet 114 is shown in FIGS. 2 and 3, the sheet 114 may overly the upper surface of the evaporator assembly 22. In the illustrated construction, the sheet 114 is in direct contact with portions of the tubes 58 to facilitate conduction heat transfer between the sheet 114 and the tubes 58 in locations where an ice cube is to be formed. Alternately, adhesive and/or cohesive bonding material may be between the sheet 114 and the tubes 58 and allow conduction heat transfer therethrough. Portions of the sheet 114 not in direct contact with the tubes 58 (i.e., at the recessed portions 68) facilitate a reduction in heat transfer between the sheet 114 and the tubes 58 in locations corresponding with the insulating members 66 in direct contact with the sheet 114. In the illustrated embodiment, the sheet 114 is made from stainless steel, but could instead be made of other materials (such as plastic), or combinations of materials (e.g. laminated or arranged in any other manner).

The sheet 114 can have a thickness which is no greater than about 0.010 inches in some embodiments. In some embodiments, the thickness of the sheet 114 is no less than about 0.003 inches and/or is no greater than about 0.005 inches. The sheet 114 is constructed in some embodiments to be attached to the microchannel tubes 58 by a non-heated process (i.e., not at or near the melting temperature of the sheet 114) by the use of adhesive or cohesive bonding material as described above and in greater detail below with regard to the embodiment of FIGS. 8-10. This bonding process can also be provided without any melting activity of the adhesive or cohesive bonding material (a process typical for welding or brazing operations), thereby significantly simplifying the assembly process.

With reference to FIG. 1, during operation of the ice-making machine 10 and the refrigeration system in a "cooling cycle," in which ice cubes are produced, the compressor 14 receives low-pressure, substantially gaseous refrigerant from the evaporator assembly 22, pressurizes the refrigerant, and discharges high-pressure, substantially gaseous refrigerant to the condenser 18. Provided the solenoid valve 26 is closed, the high-pressure, substantially gaseous refrigerant is routed through the condenser 18. In the condenser 18, heat is removed from the refrigerant, causing the substantially gaseous refrigerant to condense into a substantially liquid refrigerant.

After exiting the condenser 18, the high-pressure, substantially liquid refrigerant is dried by the dryer 30 and is routed through the heat exchanger 34. While passing through the heat exchanger 34, the high-pressure, substantially liquid refrigerant absorbs heat from the low-pressure, substantially gaseous refrigerant passing through the heat exchanger 34 en route to the inlet of the compressor 14. After exiting the heat exchanger 34, the high-pressure liquid refrigerant encounters the expansion valve 38, which reduces the pressure of the substantially liquid refrigerant for introduction into the evaporator assembly 22. Specifically, low-pressure, liquid refrigerant enters the inlet header 50 and the tubes 58. The refrigerant absorbs heat from the tubes 58 and vaporizes as the refrigerant passes through the tubes 58. Low-pressure, substantially gaseous refrigerant is discharged from the outlet header 54 for re-introduction into the inlet of the compressor 14.

As shown in FIG. 1, the evaporator assembly 22 includes baffles 120 that configure the assembly as a multi-pass evaporator. In this design, refrigerant is routed back and forth between the inlet header 50 and outlet header 54. In the illustrated construction, the evaporator assembly 22 is configured as a 3-pass evaporator. Alternatively, the evaporator assembly 22 may include more or less than three passes.

With reference to FIG. 2, the sheet 114 and rails 94 define a plurality of fluid flow channels 118 on the evaporator assembly 22. The insulating members 66 and the rails 94 divide the fluid flow channels 118 into insulated regions 122*a*, 122*b* and non-insulated regions 126 (see FIGS. 3 and 4). As used herein, "insulated region" and "non-insulated region over which water flows during an ice making operation the sheet coupled to the microchannel tube for thermal conductance therewith wherein the ice forming sheet has a thickness no greater than about 0.010 inches. are relative terms used to indicate that one region (i.e., the non-insulated region) is colder during the cooling cycle so that ice will more readily form in that region compared to the insulated region. These terms should not be interpreted to mean that one region must be insulated and the other uninsulated, or that one region must include a dedicated insulation material. The non-insulated regions 126 are regions on the sheet 114 that are arranged for sufficient thermal conduction with the tubes 58 to form ice on the sheet 114, whereas the insulated regions 122*a*, 122*b* are regions on the sheet 114 that are sufficiently thermally insulated from the tubes 58 so that ice will not form in the insulated regions 122*a*, 122*b*. In this regard, the insulated regions can be insulated by insulation material, air, an adequate combination of thermal resistance and distance, and the like.

It should be understood that the insulated regions 122*a*, 122*b* and non-insulated regions 126 can be created in a number of different ways. For example, the tubes 58 can have a thinner wall thickness in the non-insulated regions 126 compared to the insulated regions 122*a*, 122*b* in order to increase the rate at which ice is formed in the non-insulated regions 126. If the wall thickness in the insulated regions 122*a*, 122*b* is thick enough, there may be little or no need for the recessed portions 68 and insulating members 66. Alternatively, the materials used in the two regions can have different heat transfer coefficients, thus resulting in different abilities to cool the surface upon which water flows.

During operation of the illustrated ice-making machine 10 in the cooling cycle, water is routed through each of the fluid flow channels 118 along outward surfaces thereof. Water freezes on portions of the sheet 114 corresponding with portions of the tubes 58 which are in direct contact with the sheet 114 (i.e., the "non-insulated regions 126"). The insulating members 66 inhibit the freezing of water on portions of the sheet 114 spaced along the fluid flow channels 118 (i.e., the "insulated regions 122*a*"), such that separate and distinct ice cubes form in the fluid flow channels 118. The spaces between adjacent tubes 58 and the rails 94 occupying those spaces inhibit the freezing of water on portions of the sheet 114 between adjacent tubes 58 (i.e., the "insulated regions 122*b*").

To harvest the blocks of ice or the ice cubes, the cooling cycle is stopped and water is stopped from flowing through the fluid flow channels 118. The solenoid valve 26 is then opened to allow high-pressure, substantially hot gaseous refrigerant discharged from the compressor 14 to enter the evaporator assembly 22. The high-pressure, substantially hot gaseous refrigerant "defrosts" the tubes 58 in the evaporator assembly 22 to facilitate the release of ice from the sheet 114. The individual ice cubes will eventually slide down the fluid flow channels 118 and fall onto an ice rack (not shown) in a storage bin (not shown). At this time, the harvest cycle is stopped, and the cooling cycle is restarted to create more ice cubes.

Figure 5:
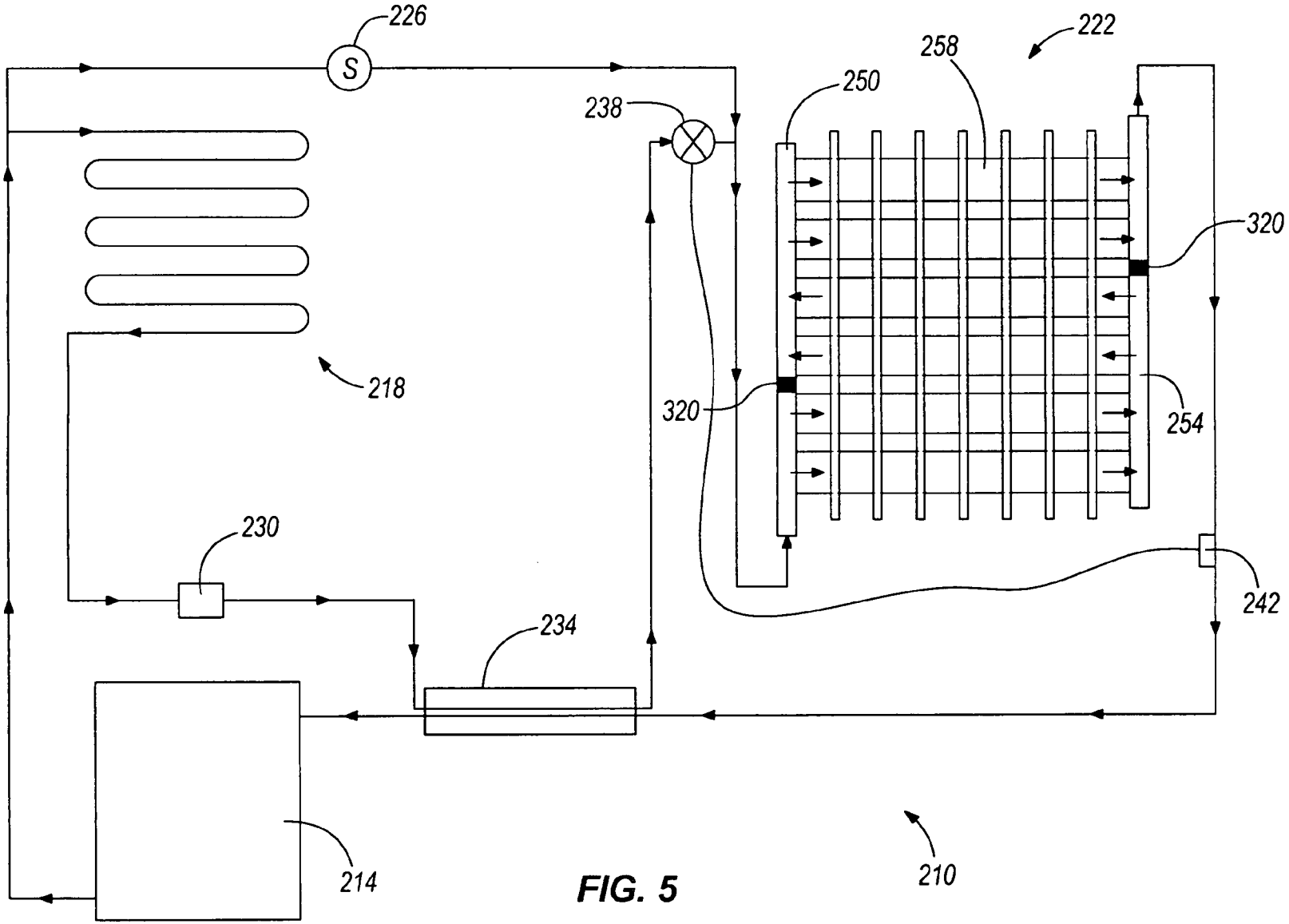
FIG. 5 is a schematic of an ice making machine according to an alternative embodiment of the present invention, including a microchannel evaporator assembly and other components of a refrigeration system.
Figure 6:
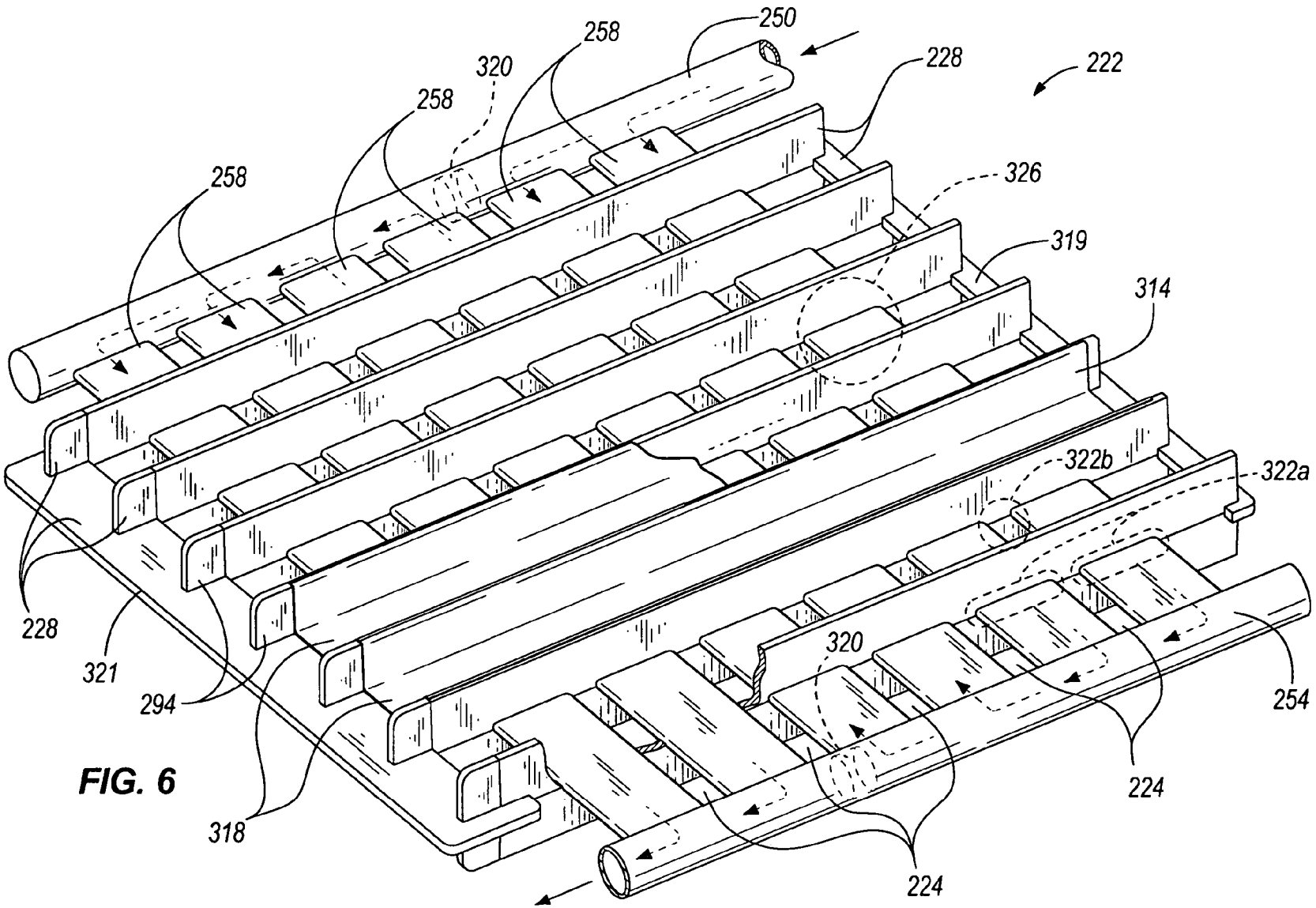
FIG. 6 is a partial cutaway perspective view of the evaporator assembly of FIG. 5.
Figure 7:
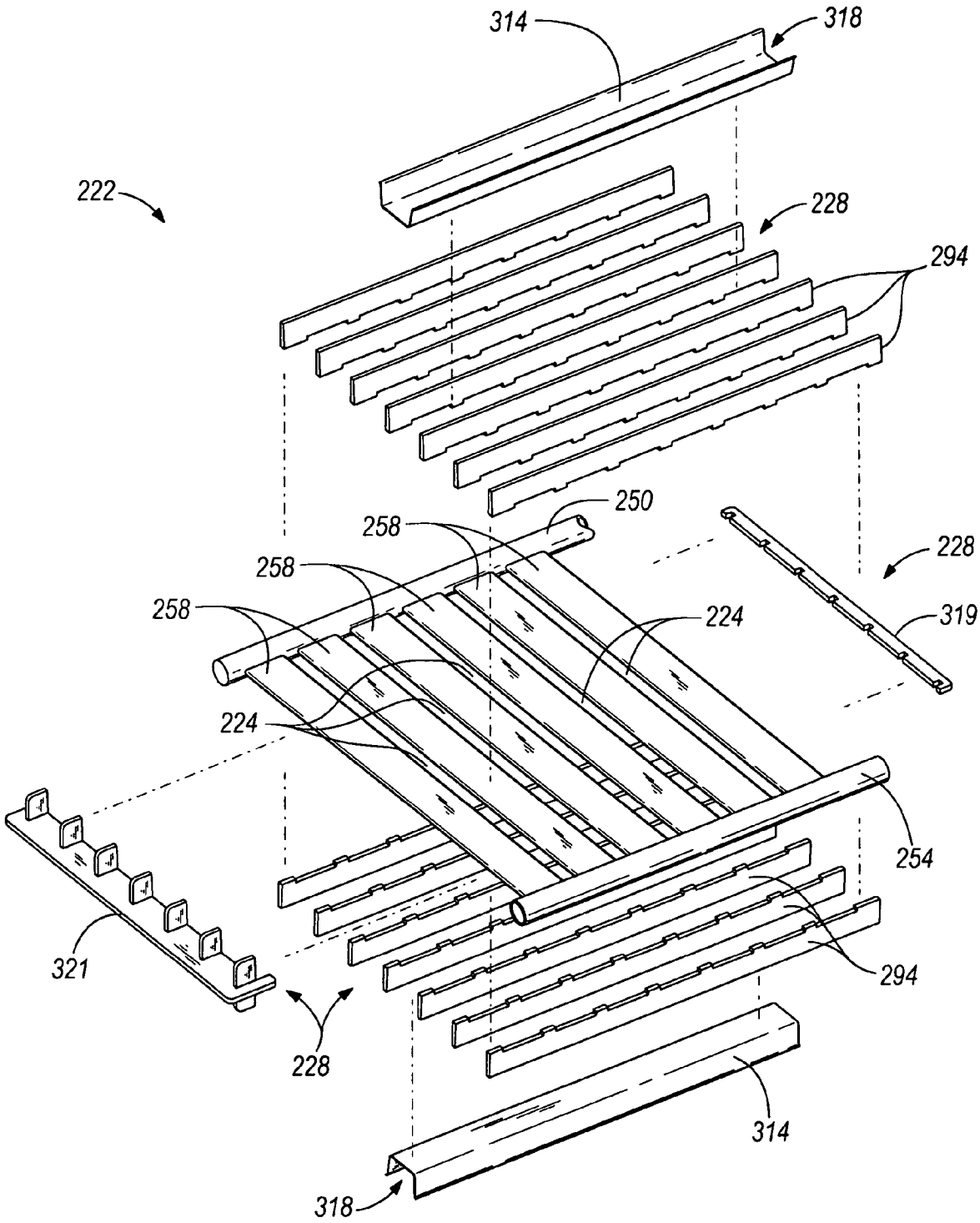
FIG. 7 is an exploded perspective view of the evaporator assembly of FIG. 5.

FIGS. 5-7 illustrate another ice making machine 210 according to an embodiment of the present invention. The elements and features of this embodiment are similar in many ways to elements and features in the embodiments described above and illustrated in FIGS. 1-4. Accordingly, the following description focuses primarily upon those elements and features that are different from the embodiments described above. Reference should be made to the above description for additional information regarding the elements, features, and possible alternatives to the elements and features of the ice making machine 210 illustrated in FIGS. 5-7 and described below.

With reference to FIG. 5, the illustrated ice making machine 210 includes a refrigeration system having a compressor 214, a condenser 218, and a microchannel evaporator assembly 222. The refrigeration system further includes a solenoid valve 226, a dryer 230, a heat exchanger 234, an expansion valve 238, and a temperature-sensing bulb 242. Feedback control is used to modulate the expansion valve 238 in response to information from the bulb 242. Water is provided to the evaporator assembly 222 via a water supply system including water supply ports.

With reference to FIGS. 6 and 7, the evaporator assembly 222 of the illustrated embodiment includes an inlet header 250, an outlet header 254, and a plurality of microchannel tubes 258 fluidly communicating the inlet header 250 and the outlet header 254. The cross-sectional shape of the tubes 258 is substantially identical to that of the tubes 58 illustrated in FIGS. 2 and 3, and can take any of the other forms described above with reference to the embodiment of FIGS. 1-4.

In operation of the illustrated evaporator assembly 222, low-pressure, substantially liquid refrigerant enters the inlet header 250 proximate the top of FIG. 6, passes through the microchannel tubes 258 as shown by the arrows in phantom in FIG. 6, and exits the evaporator assembly 222 as substantially gaseous refrigerant via the outlet header 254 proximate the bottom of FIG. 6. Flow of refrigerant through the inlet header 250, microchannel tubes 258, and outlet header 254 is determined by baffles 320 in the inlet and outlet headers 250, 254 (see FIGS. 5 and 6).

The evaporator assembly 222 further includes a frame 228 adapted to support the microchannel tubes 258 and to hold the microchannel tubes 258 in position with respect to one another. The frame 228 illustrated in FIGS. 6 and 7 sandwiches or supports the microchannel tubes 258 between first and second sides of the evaporator assembly 222, and holds the microchannel tubes 258 in a substantially parallel and spaced configuration (described in greater detail below).

The frame 228 in the illustrated embodiment includes a number of rails 294 running across the evaporator assembly 222 and crossing the microchannel tubes 258. The rails 294 extend in a substantially perpendicular manner with respect to the microchannel tubes 258, and frame the sides of a series of fluid flow channels 318 in which ice is produced by the evaporator assembly 222. The rails 294 in the illustrated embodiment extend away from the microchannel tubes 258 on both sides of the evaporator assembly 222, thereby defining a framework of fluid flow channels 318 on both sides of the evaporator assembly 222. The frame 228 further includes water entrance and exit pieces 319, 321 at opposite ends of the frame 228, both of which have surfaces across which water flows on the way into and out of the fluid flow channels 318, respectively.

The fluid flow channels 318 can be lined with a thermally conductive material, including any of the materials described above with reference to the illustrated embodiment of FIGS. 1-4. For example, the fluid flow channels 318 in the evaporator assembly 222 illustrated in FIGS. 5-7 are lined with a sheet 314, such as stainless steel sheet, a foil of other metallic material, or a non-metallic thermally conductive sheet. The sheet 314 in the illustrated embodiment of FIGS. 5-7 covers the rails 294 and the faces of the microchannel tubes 258, thereby defining the fluid flow channels 318 described above. Each fluid flow channel 318 can therefore have a generally U-shaped cross-section. Adhesive or cohesive bonding material can be used to attach the sheet 314 to the microchannel tubes 258. Bonding materials and uses thereof for this and other embodiments of the present invention described and illustrated herein are discussed in further detail below.

The sheet 314 can have a thickness which is no greater than about 0.010 inches in some embodiments. In some embodiments, the thickness of the sheet 314 is no less than about 0.003 inches and/or is no greater than about 0.005 inches. The sheet 314 is constructed in some embodiments to be attached to the microchannel tubes 258 by a non-heated process (i.e., not at or near the melting temperature of the sheet 314) by the use of adhesive or cohesive bonding material as described above and in greater detail below with regard to the embodiment of FIGS. 8-10. This bonding process can also be provided without any melting activity of the adhesive or cohesive bonding material (a process typical for welding or brazing operations), thereby significantly simplifying the assembly process.

The bottoms of the fluid channels 318 on both sides of the evaporator assembly 222 are in contact with the microchannel tubes 258 in a number of locations. At these locations, the sheet 314 lining the fluid flow channels 318 is in thermal conduction communication with the microchannel tubes 258. Therefore, these locations define non-insulated regions 326 of the fluid flow channels 318. Ice cubes can be formed in these non-insulated regions 326 during operation of the evaporator assembly 222.

The fluid flow channels 318 of the evaporator assembly 222 illustrated in FIGS. 5-7 also have a number of insulated regions 322 for purposes of producing ice in selected areas of the fluid flow channels 318. Although insulated regions 322 can be created in any of the manners described above (e.g., by insulating elements located adjacent the microchannel tubes 258, and the like), insulated regions 322 are defined in the evaporator assembly 222 by spaces 224 between adjacent microchannel tubes 258. These spaces 224 can be left empty, or can be partially or entirely occupied by other insulating structure(s) of the evaporator assembly 222. In either case, the spaces 224 between adjacent tubes 258 inhibit the conduction of heat from areas of the fluid flow channels 318 adjacent the spaces 224 to the microchannel tubes 258. The rails 294 can constitute additional insulated regions along the length of each microchannel tube 258 as they divide the length of each microchannel tube 258 into a number of ice forming locations or non-insulated regions 326.

The spaces 224 between adjacent microchannel tubes 258 can be defined in a number of different ways in an evaporator assembly 222. By way of example only, the microchannel tubes 258 in the illustrated embodiment of FIGS. 5-7 are arranged in a substantially parallel and spaced arrangement to create the spaces 224. As described above, the microchannel tubes 258 in the illustrated embodiment of FIGS. 5-7 are arranged in a direction perpendicular to the fluid flow channels 318, thereby defining the non-insulated regions 326 of the fluid flow channels 318.

With reference again to the illustrated embodiment of FIGS. 5-7, during operation of the ice-making machine 210 in the cooling cycle, water is routed through each of the fluid flow channels 318. Water freezes at locations in the fluid flow channels 318 corresponding with portions of the microchannel tubes 258 in contact with the sheet 314 lining the fluid flow channels 318 (i.e., the "non-insulated regions 326"). The spaces between adjacent microchannel tubes 258 inhibits the freezing of water in portions of the fluid flow channels 318 (i.e., the insulated regions 322*b*), such that separate and distinct ice cubes form in the fluid flow channels 318. The rails 294 across each microchannel tube 258 divide adjacent fluid flow channels 318 (i.e., with the "insulated regions 322*a*") and their respective ice forming locations (i.e., the "non-insulated regions 326"). Ice can be harvested in a manner similar to that of the first embodiment illustrated in FIGS. 1-4.

In the illustrated embodiment of FIGS. 5-7, fluid flow channels 318 are located on both sides of the evaporator assembly 222. In other embodiments, fluid flow channels 318 are located on only one side of the evaporator assembly 222.

The evaporator assembly 222 can have any orientation desired, depending at least partially upon the position and orientation of the fluid flow channels 318 described above and upon the flow path of water through the evaporator assembly 222. For example, an evaporator assembly 222 having fluid flow channels 318 on both sides of the evaporator assembly 222 (see FIGS. 6 and 7) can be oriented substantially vertically or at a relatively steep angle, whereas an evaporator assembly 222 having fluid flow channels 318 on only one side of the evaporator assembly 222 can be oriented at a relatively small angle with respect to a horizontal plane.

Figure 8:
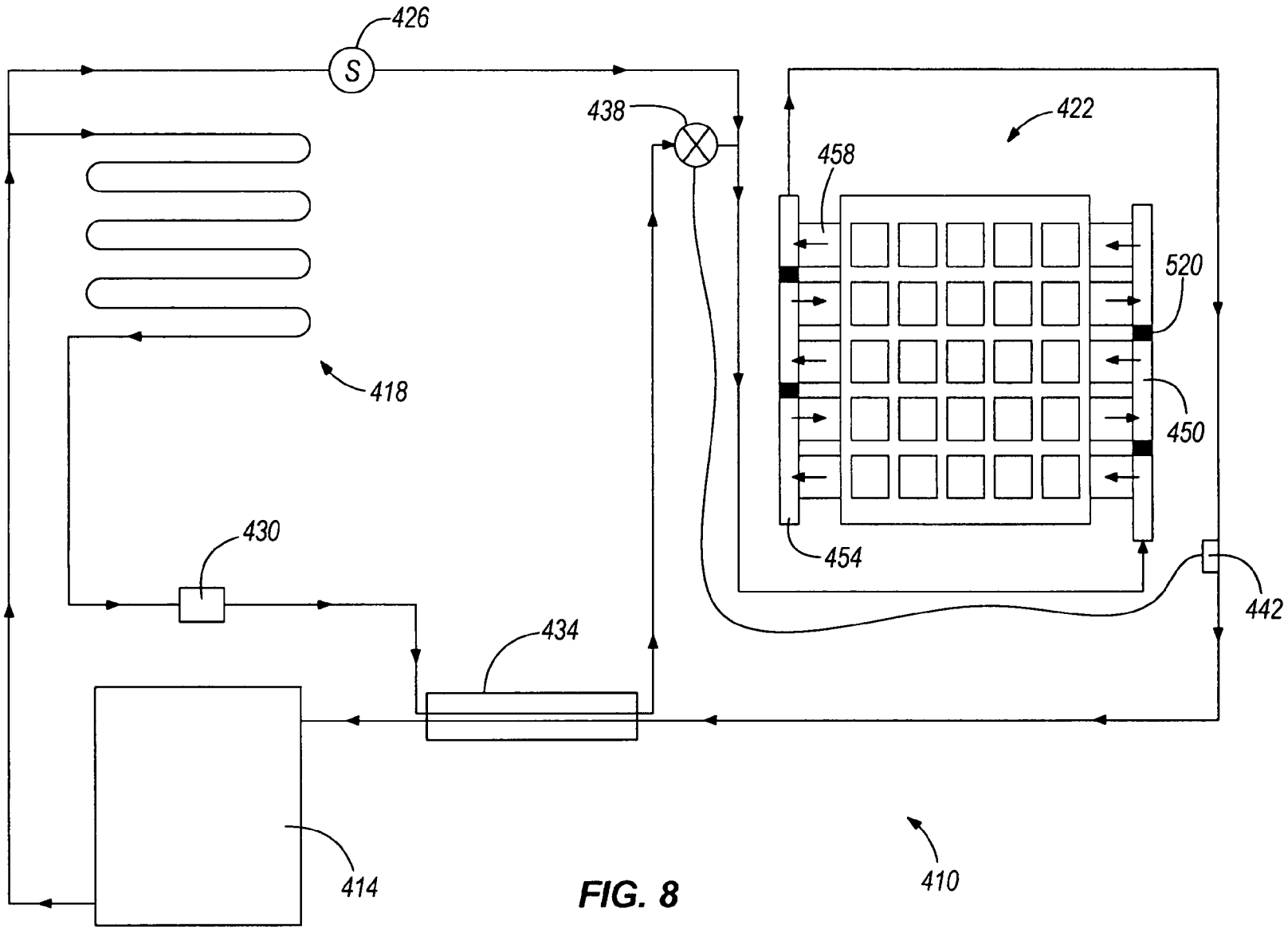
FIG. 8 is a schematic of an ice making machine according to an alternative embodiment of the present invention, including a microchannel evaporator assembly and other components of a refrigeration system.
Figure 9:
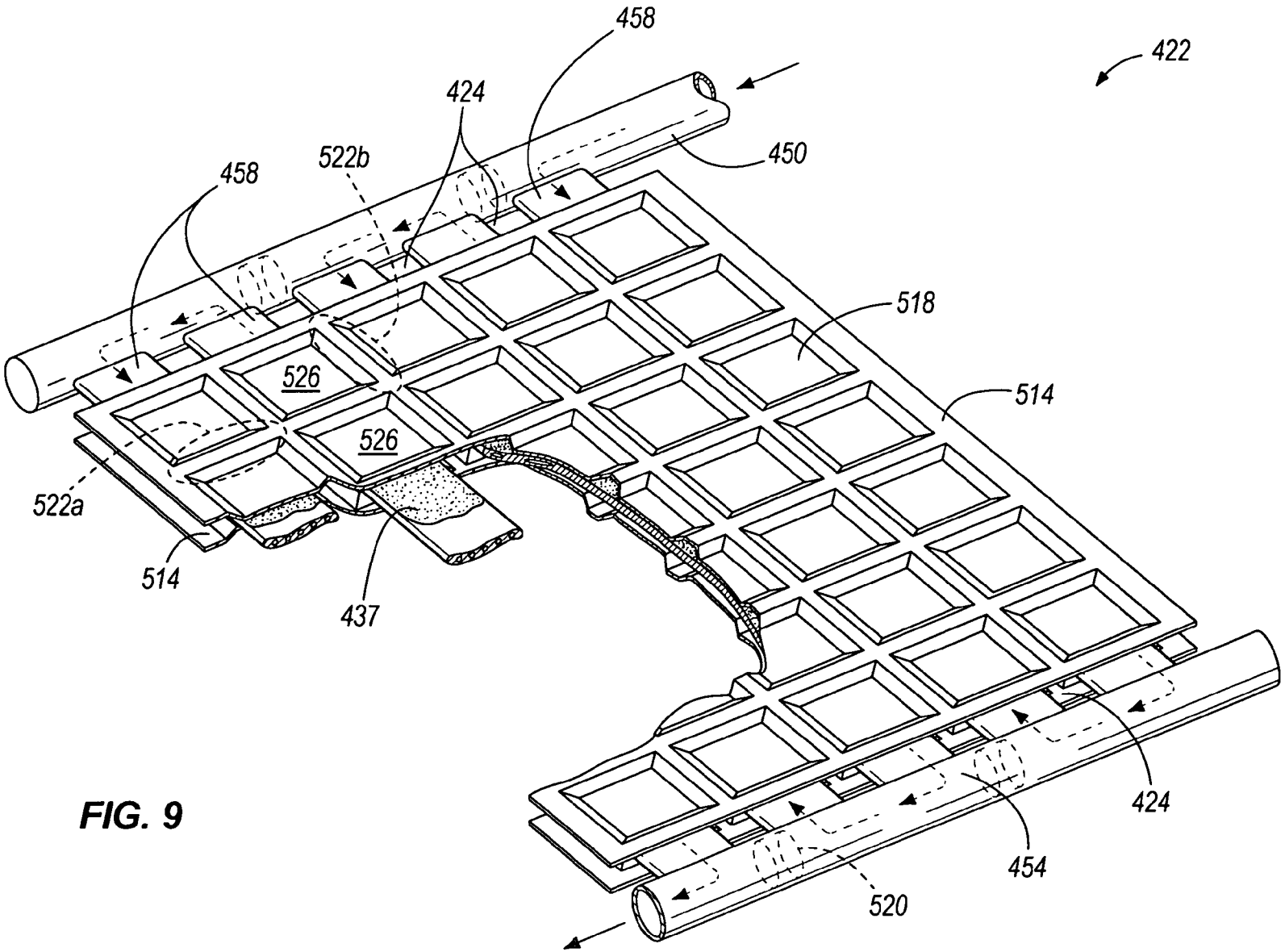
FIG. 9 is a partial cutaway perspective view of the evaporator assembly of FIG. 8.
Figure 10:
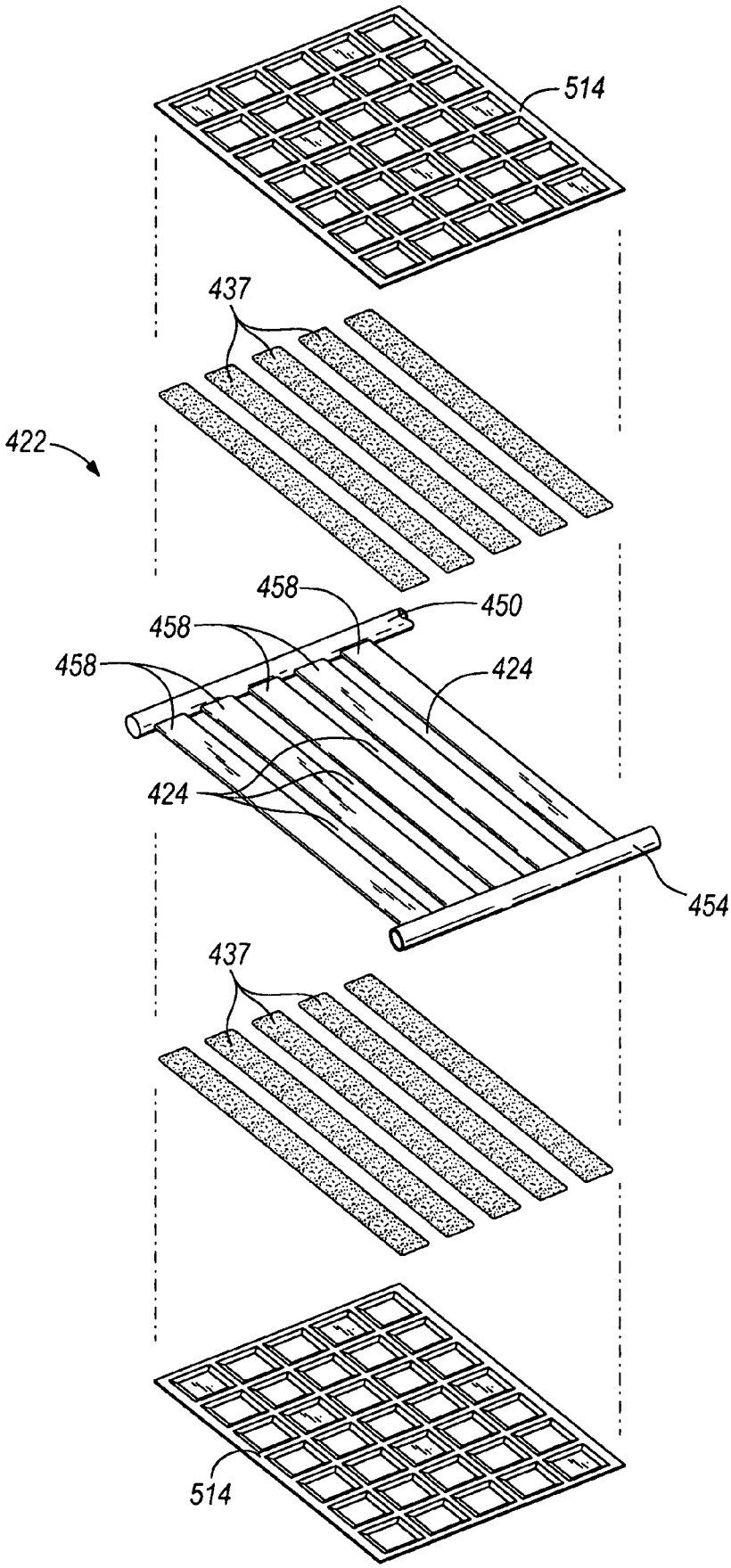
FIG. 10 is an exploded perspective view of the evaporator assembly of FIG. 8.

FIGS. 8-10 illustrate an ice making machine 410 according to another embodiment of the present invention. The elements and features of this embodiment are similar in many ways to elements and features in the embodiments described above in connection with FIGS. 1-7. Accordingly, the following description focuses primarily upon those elements and features that are different from the embodiments described above (except where otherwise noted). Reference should be made to the above description for additional information regarding the elements, features, and possible alternatives to the elements and features of the ice making machine 410 illustrated in FIGS. 8-10 and described below.

With reference to FIG. 8, the illustrated ice making machine 410 includes a refrigeration system having a compressor 414, a condenser 418, and a microchannel evaporator assembly 422. The refrigeration system further includes a solenoid valve 426, a dryer 430, a heat exchanger 434, an expansion valve 438, and a temperature-sensing bulb 442. Feedback control is used to modulate the expansion valve 438 in response to information from the bulb 442. Water is provided to the evaporator assembly 422 via a water supply system including water supply ports. With the exception of the evaporator assembly (described in greater detail below), the refrigeration system is substantially unchanged from that of the previously described embodiments.

With additional reference to FIGS. 9 and 10, the illustrated evaporator assembly 422 includes an inlet header 450, an outlet header 454, and a plurality of microchannel tubes 458 therebetween. The evaporator assembly 422 provides an example of a different type of refrigerant flow path through the inlet header 450, outlet header 454, and microchannel tubes 458, wherein the serpentine path of refrigerant through the evaporator assembly 422 is a single path rather than a dual parallel serpentine path as illustrated in the earlier embodiments. Accordingly, the inlet and outlet headers 450, 454 in the embodiment of FIGS. 8-10 are provided with additional baffles 520 to result in the single serpentine path shown. Still other types of refrigerant paths through the evaporator assembly 422 are possible, and fall within the spirit and scope of the present invention.

A sheet 514 of material having recesses 518 is positioned on each side of the microchannel tubes 458, thereby enabling the production of ice on both sides of the evaporator assembly 422 as will be described in greater detail below. In other embodiments, only one side of the evaporator assembly 422 is provided with a sheet upon which ice is formed. Each sheet 514 can be formed from a single sheet of material, such that recesses 518 can be completely defined by the sheet 514 (e.g., such as by die, press, cast, mold, etc.). In some embodiments, a number of such recesses 518 can be defined in and by the same sheet. For example, in some embodiments, all of the recesses 518 on a side of the evaporator 518 are defined by the same sheet 514. Each recess can be completely defined by the same sheet 514. In this manner, the ice-forming surfaces for each individual cube need not necessarily be constructed of multiple pieces assembled together as is common in the art.

Between each sheet 514 and the microchannel tubes 458 is a bonding material 437. The bonding material 437 is positioned to bond each sheet 514 to the microchannel tubes 458. In some embodiments (e.g., in some cases where the bonding material 437 is applied only to the microchannel tubes 458 during assembly), the bonding material 437 only contacts the bottom of each recess 518. In other embodiments (e.g., in some cases where the bonding material 437 is applied only to the underside of the sheet 514 during assembly), the bonding material 437 can contact the bottom of each recess 518 and areas surrounding each recess 518. The bonding material 437 couples the bottoms of the recesses 518 to the microchannel tubes 458. By virtue of the flat shape of the microchannel tubes 458 and the non-planar shape of each sheet 514, a number of insulated regions 522*a* are defined between the sheets 514 and the microchannel tubes 458. Additional insulated regions 522*b* are defined between adjacent microchannel tubes 458. Either or both types of insulated regions can be empty or can be partially or entirely filled with any thermally insulative material desired to prevent the formation of ice between the recesses 518. Likewise, the bottoms of the recesses 518 are in thermal conduction communication with the microchannel tubes 458, and thereby define locations upon which ice forms during operation of the refrigeration system as described with reference to previous embodiments of the invention.

The bonding material 437 used to connect the sheets 514 to the microchannel tubes 458 can include epoxy, glue, tape, or other adhesive or cohesive bonding material. In some embodiments, the bonding material 437 is double-sided tape. The bonding material 437 can be thermally conductive or relatively non-thermally conductive. In some embodiments, the bonding material 437 includes a foam adhesive or cohesive bonding material. In such embodiments, the bonding material can be a closed cell foam. Also, the bonding material 437 can comprise a visco-elastic foam, and can be substantially moisture-resistant or water-impermeable. Moisture-resistant or water-impermeable tape can be used to prevent water from entering spaces between the sheet(s) 514 and the microchannel tubes 458, which in some cases can shorten the life of the evaporator assembly 422 and/or reduce its efficiency. The bonding material 437 in the illustrated embodiment of FIGS. 8-10 is 3-M™ VHB™ visco-elastic acrylic foam double-sided tape, is moisture resistant, and can be obtained in varieties suitable for low temperature applications, such as temperatures at or below 0 degrees Celsius. Adhesive and/or cohesive bonding material can be provided according to the description given above in other structural embodiments of the invention.

With continued reference to the illustrated embodiment of FIGS. 8-10, the sheet 514 comprises a thin layer of thermally conductive material, such as stainless steel. In other embodiments, the sheet 514 can comprise other thermally conductive materials. In some embodiments, the sheet 514 can have a thickness no greater than about 0.010 inches. In some embodiments, the sheet 514 can have a thickness of no less than about 0.003 inches and no greater than about 0.005 inches. Thin sheet thickness can make welding, brazing, and other heat intensive or melting processes unacceptable for coupling sheets 514 to the microchannel tubes 458. Thus, a bonding process which forms a bond between the microchannel tubes 458 and the sheets 514 without approaching the melting temperature of either the tubes 458 or the sheets 514 can be utilized. This bonding process can also be provided without any melting activity of the adhesive or cohesive bonding material (a process typical for welding or brazing operations), thereby significantly simplifying the assembly process. The sheet thicknesses and bonding processes described above can also be applied to any of the other embodiments of the present invention.

The recesses 518 in the illustrated embodiment have a substantially square shape with beveled edges, although in other embodiments the recesses 518 can have sides that are substantially orthogonal to the bottoms of the recesses 518. The beveled edges of the recesses in the illustrated embodiment assist in releasing ice during the harvesting process. One of ordinary skill in the art will appreciate that many different shapes of recesses 518 can be employed, including round, oval, trapezoidal, irregular, and other shapes. The recesses 518 in the illustrated embodiment of FIGS. 8-10 are arranged in rows along the length of each microchannel tube 458. The insulated regions 522*a* between adjacent recesses 518 in a given row prevent localized ice formation, and thereby create a division between adjacent ice cubes along each microchannel tube 458. Between the recesses 518 of adjacent rows, insulated regions 522*b* perform a similar function. Also, spaces 424 between adjacent microchannel tubes 458 provide additional insulation at the insulated regions 522*b*.

Figure 11:
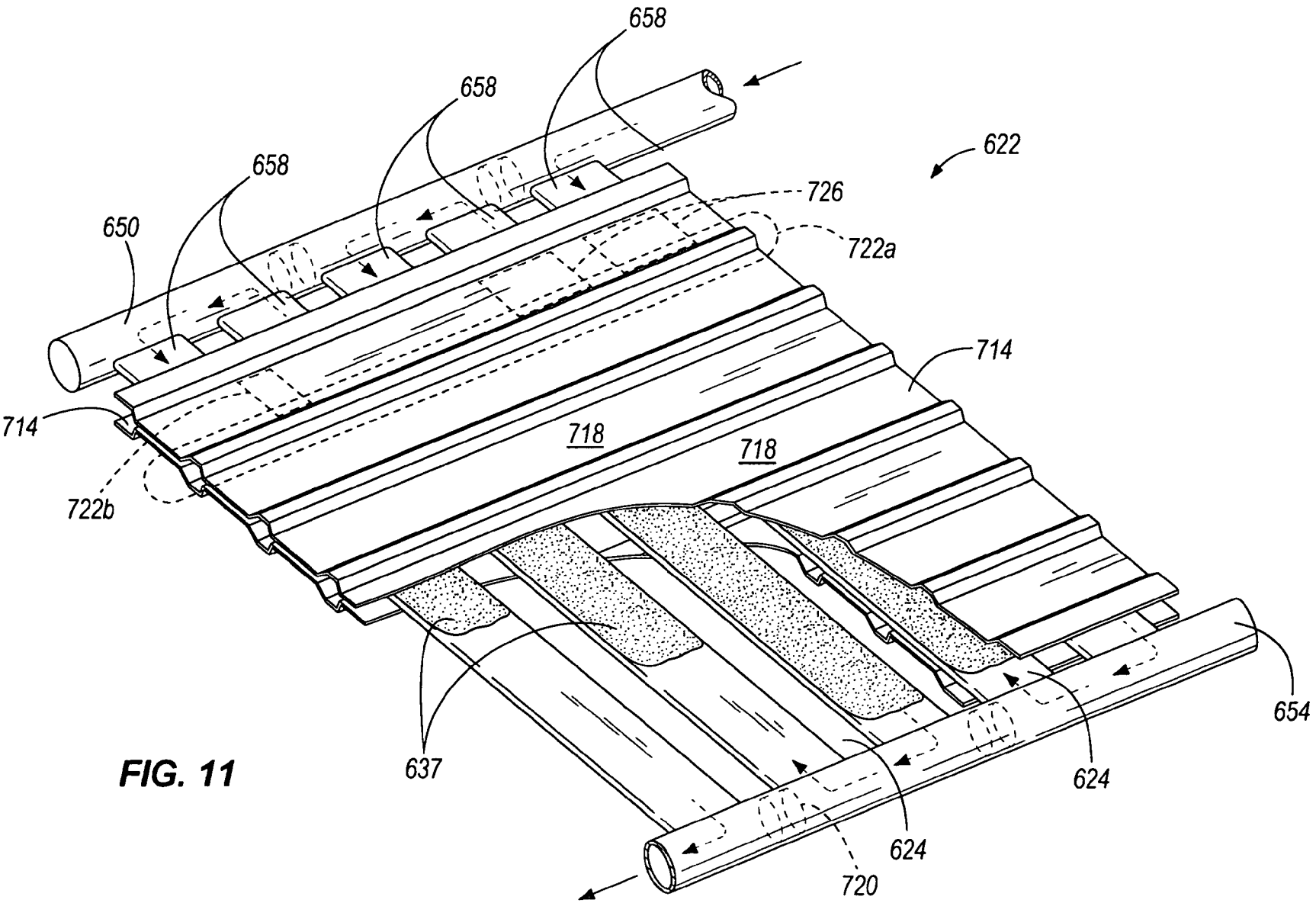
FIG. 11 is a partial cutaway perspective view of a microchannel evaporator assembly according to another alternative embodiment of the present invention.

FIG. 11 illustrates a microchannel evaporator assembly 622 according to another embodiment of the present invention. The elements and features of this embodiment are similar in many ways to elements and features in the embodiments described above in connection with FIGS. 1-10. Accordingly, the following description focuses primarily upon those elements and features that are different from the embodiments described above. Reference should be made to the above description for additional information regarding the elements, features, and possible alternatives to the elements and features of the microchannel evaporator assembly 622 illustrated in FIG. 11 and described below.

The evaporator assembly 622 illustrated in FIG. 11 includes sheets 714 of thermally conductive material overlying a number of microchannel tubes 658. The sheets 714 can be similar in construction to those described in detail above, but being shaped in a different form. Each sheet 714 is formed with channels 718 running along a direction substantially perpendicular to the tubes 658. Similar to previously-described embodiments, the evaporator assembly 622 is provided with insulated regions 722*a*, 722*b* and non-insulated regions 726. In the embodiment shown in FIG. 11, the insulated regions 722*a* run between and are parallel to adjacent channels 718. The insulated regions 722*a* provide an insulating effect by creating a gap between each sheet 714 and the microchannel tubes 658, significantly reducing the amount of heat transferred therebetween. In some embodiments, the insulated regions 722*a* create a gap only above the microchannel tubes 658, such that the insulated regions 722*a* are periodically interrupted between microchannel tubes 658. The insulated regions 722*b* are maintained, as in previous embodiments, by the spaces 624 between adjacent tubes 658. As described in earlier embodiments, any or all of the insulated regions 722*a*, 722*b* can be partially or entirely filled with insulating material, or can instead be empty as shown in FIG. 11. A bonding material 637 (described in greater detail above with reference to the embodiment of FIGS. 8-10) is provided between the tubes 658 and each sheet 714 in order to couple the sheets 714 to the microchannel tubes 658. In some embodiments, only one side of the evaporator assembly 622 is provided with a sheet 714 of thermally conductive material.

It should be noted that the sheets 714 in the illustrated embodiment of FIG. 11 are sufficiently rigid to maintain the shape of each channel 718 (following repeated ice forming and harvesting cycles) without the need for a frame or base for structural integrity of the assembly. Also, the use of bonding material 637 to couple the sheets 714 to the microchannel tubes 658 provides sufficient structural strength to retain the microchannel tubes 658 in the desired spaced positions with respect to one another.

Figure 12:
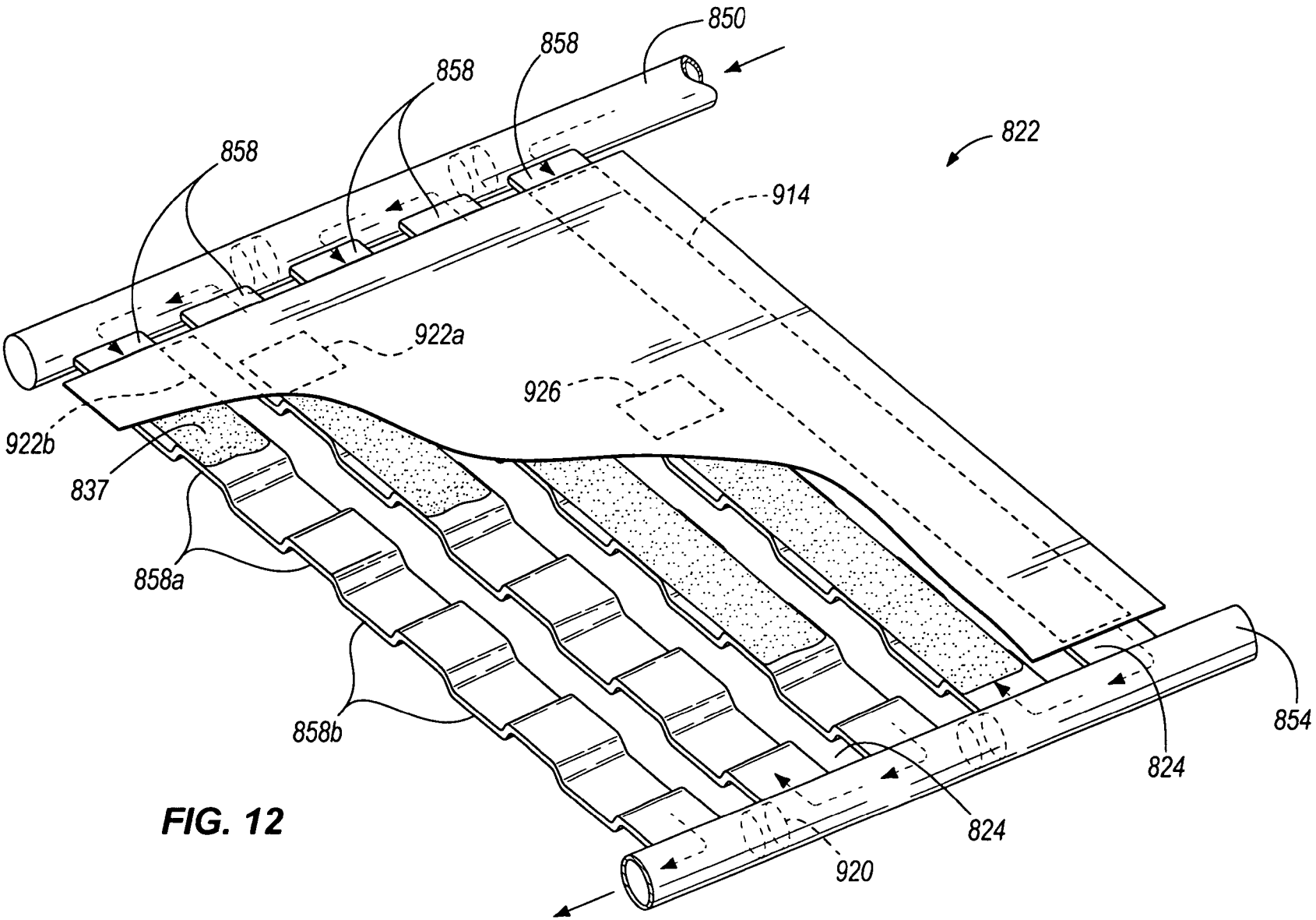
FIG. 12 is a partial cutaway perspective view of a microchannel evaporator assembly according to yet another alternative embodiment of the present invention.

FIG. 12 illustrates another microchannel evaporator assembly 822 according to yet another embodiment of the present invention. The elements and features of this embodiment are similar in many ways to elements and features in the embodiments described above in connection with FIGS. 1-11. Accordingly, the following description focuses primarily upon those elements and features that are different from the embodiments described above. Reference should be made to the above description for additional information regarding the elements, features, and possible alternatives to the elements and features of the microchannel evaporator assembly 822 illustrated in FIG. 12 and described below.

The evaporator assembly 822 illustrated in FIG. 12 includes sheets 914 of heat-conductive material overlying a number of microchannel tubes 858. Both sheets 914 are substantially flat. Microchannel tubes 858 are positioned between an inlet header 850 and an outlet header 854. As illustrated, the microchannel tubes 858 are substantially non-planar, such that each tube 858 includes alternating upper portions 858*a* and lower portions 858*b* (upper and lower being relative terms used only to describe the orientation as illustrated in FIG. 12). The sheets 914 are positioned upon opposite sides of the microchannel tubes 858, and are coupled to the microchannel tubes 858 by a bonding material 837. By virtue of the shapes of the microchannel tubes 858, insulated regions 922*a*, 922*b* and non-insulated regions 926 exist at different locations along the sheet 914. Non-insulated regions 926 exist at locations where the sheet 914 is coupled to the upper portions 858*a* of the microchannel tubes 858, while insulated regions 922*a*, 922*b* exist at locations where the sheet 914 is not bonded to the tubes 858 (i.e., adjacent each lower portion 858*b*) and adjacent spaces 824 between adjacent tubes 858, respectively. In some embodiments, only one side of the evaporator assembly 822 is provided with a sheet 914 of thermally conductive material.

The sheets 914 in the illustrated embodiment of FIG. 12 are sufficiently rigid to maintain the flat shape of the sheets 914 without the need for a frame or base for structural integrity of the assembly. Also, the use of bonding material 837 to couple the sheets 914 to the microchannel tubes 858 provides sufficient structural strength to retain the microchannel tubes 858 in the desired spaced positions with respect to one another.

Figure 13:
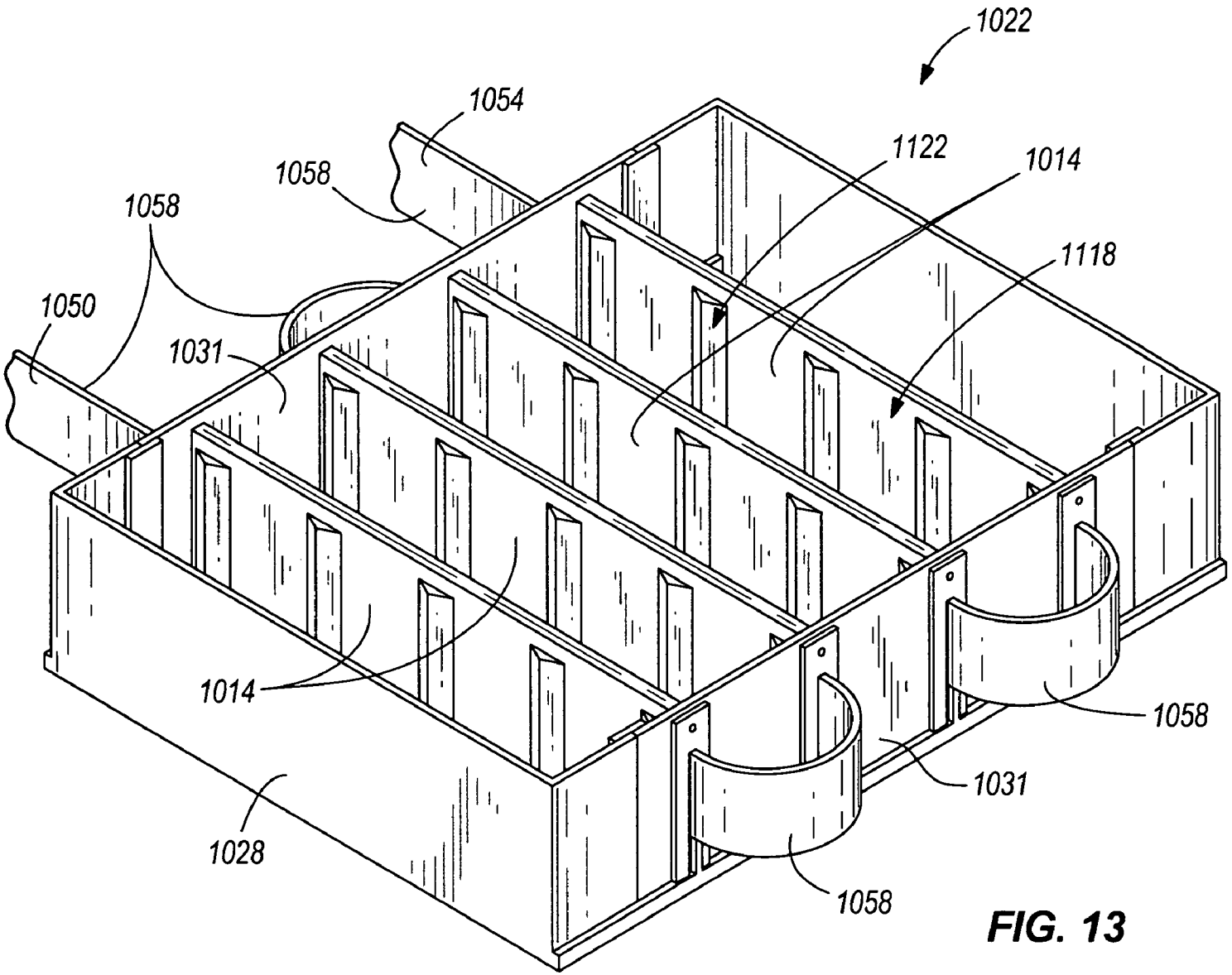
FIG. 13 is a perspective view of an evaporator according to another embodiment of the present invention.
Figure 14:
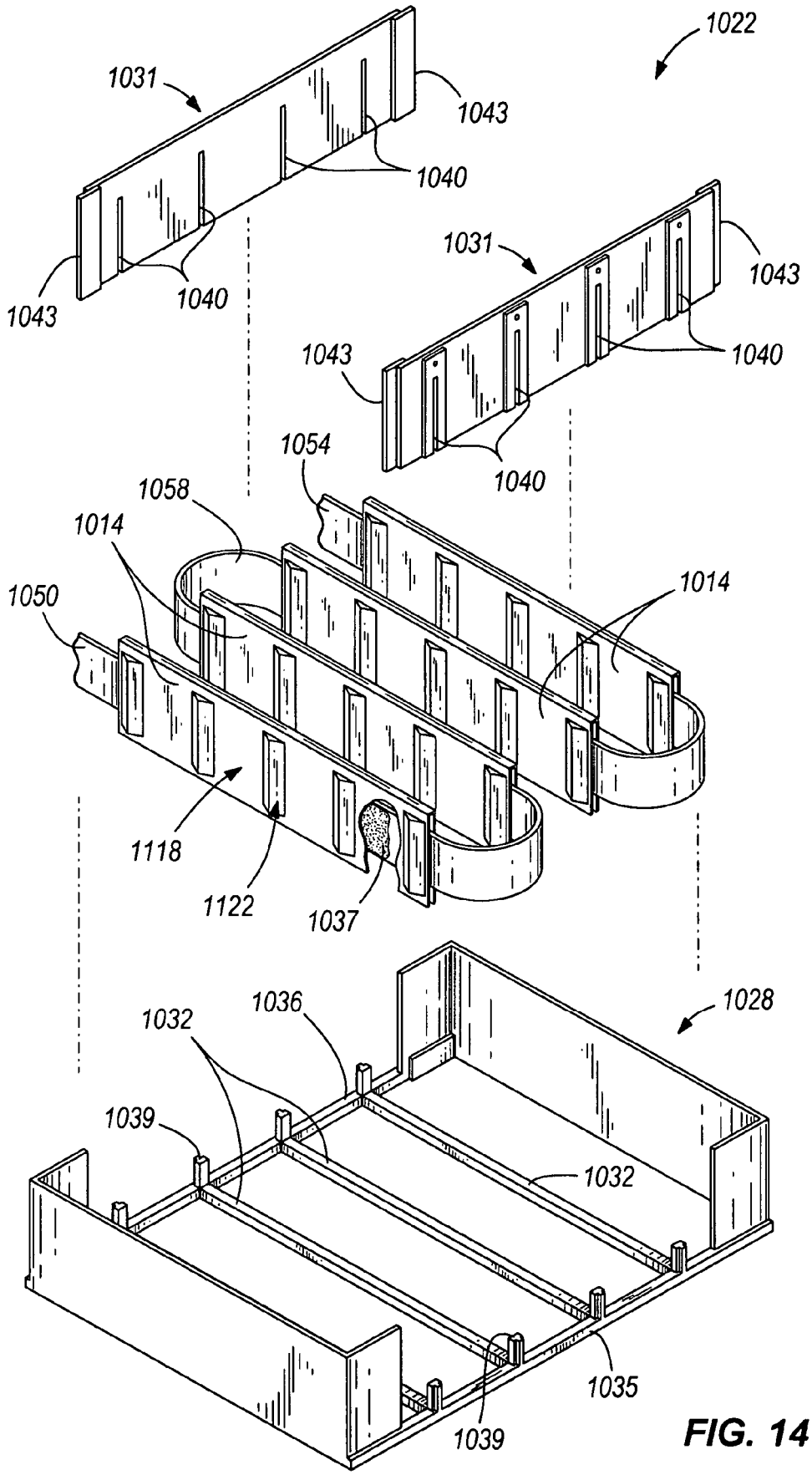
FIG. 14 is an exploded perspective view of the evaporator illustrated in FIG. 13.

FIGS. 13 and 14 illustrate a microchannel evaporator assembly 1022 according to another embodiment of the present invention. The elements and features of this embodiment are similar in many ways to elements and features in the embodiments described above in connection with FIGS. 1-12. Accordingly, the following description focuses primarily upon those elements and features that are different from the embodiments described above. Reference should be made to the above description for additional information regarding the elements, features, and possible alternatives to the elements and features of the microchannel evaporator assembly 1022 illustrated in FIGS. 13 and 14 and described below.

The evaporator assembly 1022 illustrated in FIGS. 13 and 14 provides an example of the manner in which microchannel tubes 1058 and sheets 1014 can be oriented and arranged differently while still falling within the spirit and scope of the present invention. For example, the evaporator assembly 1022 illustrated in FIGS. 13 and 14 utilizes a number of sheets 1014 defining different portions of the evaporator assembly 1022. Also, FIGS. 13 and 14 provide an example of how an evaporator assembly 1022 can have two or more non-coplanar sheets 1014 coupled at different locations along the length of one or more microchannel tubes 1058.

The evaporator assembly 1022 illustrated in FIGS. 13 and 14 includes a housing 1028 and sheets 1014 of thermally conductive material overlying microchannel tubes 1058. The housing 1028 of the illustrated embodiment is substantially rectangular, and includes opposing support members 1031. The housing 1028 includes ribs 1032 extending between first and second opposing sides 1035, 1036. Support posts 1039 extend substantially vertically from the ribs 1032. The support members 1031 are substantially identical and comprise a majority of the first and second sides 1035, 1036. The support members 1031 define a plurality of substantially vertical apertures 1040. The housing 1028 is adapted to receive the support members 1031 such that the apertures 1040 of the support members 1031 at least partially receive the support posts 1039 of the housing 1028. The support members 1031 also include tabs 1043 that support the support members 1031 with respect to the housing 1028.

In other embodiments, the housing 1028 can have any other shape adapted to support the microchannel tubes 1058. For example, the housing 1028 can be longer or wider than that shown in FIGS. 13 and 14 in order to accommodate more passes of the microchannel tube 1058 or to accommodate longer passes of the microchannel tube 1058, respectively. As another example, the housing 1028 can be thicker than that shown in FIGS. 13 and 14 in order to accommodate a wider microchannel tube 1058. In other embodiments, no housing 1028 exists, in which case the microchannel tube 1058 and the sheets 1014 can be supported with respect to a structure (e.g., within an ice making machine) in any other suitable manner.

The microchannel tubes 1058 of the embodiment illustrated in FIGS. 13-14 are arranged in a non-planar, serpentine configuration between an inlet 1050 and an outlet 1054. The serpentine configuration can provide a single piece of microchannel tubing 1058 for refrigerant flow through the evaporator assembly 1022. In other embodiments, this serpentine configuration is defined by two or more pieces of microchannel tubing are 1058 connected end-to-end (i.e., in series) in any manner.

With continued reference to the embodiment illustrated in FIGS. 13-14, the serpentine configuration can be formed by bending the microchannel tubing 1058. Alternatively, one or more of the bent portions of the microchannel tubing 1058 illustrated in FIGS. 13-14 can be replaced by another tube (e.g., a separate manifold or other connecting tube, another piece of microchannel tubing, and the like) coupled to the other illustrated portions of the microchannel tubing 1058. If employed, inlet and outlet manifolds (or other connecting tubes) can be used as described earlier to define serpentine flow, parallel flow, or other flow paths through the tubes 1058.

The tubes 1058 illustrated in FIGS. 13-14 are adapted to extend through the apertures 1040 of the support members 1031, and to rest on the support posts 1039. The tubes 1058 extend through the housing 1028 four times. In some embodiments, the tubes 1058 extend through a larger or smaller housing a greater or lesser number of times, depending on output capacity required of the evaporator assembly 1022.

The sheets 1014 of thermally conductive material can include substantially flat regions 1118 configured to exchange heat with the microchannel tubes 1058 and insulated regions 1122 configured to prevent heat transfer between the sheets 1014 and the microchannel tubes 1058. As described in earlier embodiments, any or all of the insulated regions 1122 can be partially or entirely filled with insulating material, or can be otherwise void of thermally conductive material. A bonding material 1037 (described in greater detail above in connection with the embodiment of FIGS. 8-10) is provided between the tubes 1058 and each sheet 1014 in order to couple the sheets 1014 to the microchannel tubes 1058. In the illustrated embodiment of FIGS. 13-14, the sheets 1014 are folded in half such that they substantially surround the microchannel tubes 1058, and permit formation of ice on both sides of the tubes 1058. Alternatively, sheets 1014 on opposite sides of the microchannel tube 1058 can define one or more sleeves surrounding the microchannel tube 1058, such as by sliding a sleeve to a desired location along the microchannel tube 1058 before bending the microchannel tube 1058 as described above. In some embodiments, separate sheets 1014 can be coupled to the opposite sides of the microchannel tubes 1058.

It should be noted that the sheets 1014 in the illustrated embodiment of FIGS. 13-14 are sufficiently rigid to maintain the shape of each insulated region 1122 (following repeated ice forming and harvesting cycles) without the need for a frame or base for structural integrity of the assembly. Also, the use of bonding material 1037 to couple the sheets 1014 to the microchannel tubes 1058 provides sufficient structural strength to retain the sheets 1014 with respect to the microchannel tubes 1058. The insulated regions 1122 in the embodiment of FIGS. 13-14 are defined by projections formed in the sheets 1014. In some embodiments, the insulated regions 1122 can be any desired shape to alter the shape of the ice formed on the flat regions 1118. In the illustrated embodiment of FIGS. 13-14, nozzles (not shown) are positioned to spray water on the sheets 1014 to form ice. In some embodiments, water can flow over the sheets 1014 to form ice as is described in earlier embodiments.

The evaporator assembly 1022 illustrated in FIGS. 13-14 includes one serpentine piece of microchannel tubing 1058 overlaid by sheets 1014 of material on opposite faces of the microchannel tubing 1058. In some embodiments, two or more pieces of microchannel tubing 1058 can be positioned in a vertically-aligned and stacked configuration to increase the output capacity of the evaporator assembly 1022. Accordingly, one or more additional serpentine-shaped microchannel tubes 1058 overlaid with sheets 1014 can be positioned above or below the microchannel tubing 1058 and sheets 1014 illustrated in FIGS. 13-14, whereby water flowing over the flat regions 1118 of one sheet 1014 then flow over another flat region 1118 of an adjacent sheet 1014, thereby providing additional ice making capacity, as desired. By utilizing two or more of such microchannel and tube assembly "layers", different portions of the evaporator assembly 1022 can be operated independently of one another. Therefore, different potions of such an evaporator assembly 1022 can be selectively activated in order to adjust the rate of ice production of the evaporator assembly 1022.

Each pass of the microchannel tubing 1058 illustrated in FIGS. 13-14 produces a single row of ice on each side of the microchannel tubing 1058. In other embodiments, two or more parallel and spaced microchannel tubes 1058 are sandwiched between the same sheets 1014, thereby enabling two or more rows of ice to be produced on each side of the microchannel tubing 1058.

In the embodiment illustrated in FIGS. 13-14, water is sprayed onto the sheets 1014 in order to form ice thereon. In other embodiments, water can flow over the sheets 1014 from an overhead water manifold, gutter, or other water source.

The evaporator assembly 1022 illustrated in FIGS. 13-14 has a number of non-insulated regions 1118 on which ice form and a number of insulated regions 1122 on which ice does not form. The insulated regions 1122 illustrated in FIGS. 13-14 are defined by ribs as described above. However, any of the various manners described herein for defining insulated and non-insulated regions can also or instead be utilized. For example, substantially flat sheets 1014 (e.g., without ribs or other insulating features) can be coupled to non-planar microchannel tubing 1058, such as any of the non-planar microchannel tubing 1058 disclosed above in connection with the embodiment of FIG. 12. In such embodiments, the insulated regions can be defined at least in part by a space between the flat sheets 1014 and the non-planar microchannel tubing.

As another example, the sheets 1014 illustrated in FIGS. 13-14 can have other insulating features, such as any of the recess shapes described above in connection with the embodiment of FIGS. 8-10. As yet another example, the microchannel tubing 1058 can be shaped to at least partially receive any of the types of insulating members described above in connection with the embodiment of FIGS. 1-4. In short, any of the features of any of the evaporator assemblies disclosed herein can be combined with any of the features from another of the evaporator assemblies so long as such features are not mutually exclusive or inconsistent with one another.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims. Various features and advantages of the invention are set forth in the following claims.

We claim:

1. An ice making machine evaporator for forming ice, the evaporator comprising:

a microchannel tube having internal walls defining a plurality of flow paths through the microchannel tube;

a sheet having a first surface over which water flows during an ice making operation, the sheet coupled to the microchannel tube for thermal conductance therewith; and at least one of adhesive and cohesive bonding material coupling the first surface and the microchannel tube, the at least one of adhesive or cohesive bonding material separating the first surface and the microchannel tube.

2. The ice making machine evaporator of claim 1, wherein a plurality of recesses are defined in the sheet and at least partially define ice forming locations of the sheet.

3. The ice making machine evaporator of claim 2, wherein the plurality of recesses are integrally formed with the sheet.

4. The ice making machine evaporator of claim 2, wherein the recesses are substantially rectangular.

5. The ice making machine evaporator of claim 1, wherein the at least one of adhesive and cohesive bonding material is tape.

6. The ice making machine evaporator of claim 5, wherein the tape is a foam tape.

7. The ice making machine evaporator of claim 6, wherein the tape is a visco-elastic foam tape.

8. The ice making machine evaporator of claim 1, wherein the sheet is a first sheet, the ice making machine evaporator further comprising a second sheet over which water flows during an ice making operation, the second sheet coupled to the microchannel tube on a side of the microchannel tube opposite the first sheet, the second sheet coupled to the microchannel tube for thermal conductance therewith.

9. The ice making machine evaporator of claim 1, wherein the sheet has a thickness no greater than about 0.010 inches.

10. The ice making machine evaporator of claim 1, wherein the sheet has a thickness no greater than about 0.005 inches.

11. An evaporator assembly for an ice making machine, the evaporator assembly comprising:

an ice forming sheet defining a plurality of ice forming locations, each of the plurality of ice forming locations having a width;

a plurality of microchannel evaporator tubes, each of the plurality of microchannel evaporator tubes having a plurality of internal refrigerant passages and having a width substantially equal to the width of each of the plurality of ice forming locations;

first insulating regions defined between adjacent ones of the plurality of microchannel evaporator tubes;

second insulating regions defined between adjacent ice forming locations along each one of the plurality of microchannel evaporator tubes; and at least one of adhesive and cohesive bonding material coupling the ice forming sheet to each of the plurality of microchannel evaporator tubes, the at least one of adhesive or cohesive bonding material separating the ice forming sheet from each of the plurality of microchannel evaporator tubes.

12. The evaporator assembly of claim 11, wherein the second insulating regions are defined at least in part by respective spaces between the ice forming sheet and the microchannel evaporator tubes at the second insulating regions.

13. The evaporator assembly of claim 12, wherein the spaces are at least partially defined by recesses in the ice forming sheet.

* * * * *